US006126435A

United States Patent [19]

Fredin-Garcia et al.

[11] Patent Number: 6,126,435

[45] Date of Patent: Oct. 3, 2000

[54] ELECTRONIC IGNITION SYSTEM FOR A GAS STOVE

[75] Inventors: David H. Fredin-Garcia; Jorge Rodriguez-Rodriguez, both of San Luis Potosi, Mexico

[73] Assignee: Vitromatic Comercial, S.A. De C.V., Monterrey, Mexico

[21] Appl. No.: 09/141,976

[22] Filed: Aug. 28, 1998

Related U.S. Application Data

[63] Continuation-in-part of application No. 08/948,597, Oct. 10, 1997, abandoned.

[30] Foreign Application Priority Data

Oct. 11, 1996 [MX] Mexico ..... 964738

[51] Int. Cl.[7] ..... F23N 5/24

[52] U.S. Cl. ..... 431/14; 431/13; 431/15; 431/71; 431/75; 431/78; 431/278; 431/281; 340/579

[58] Field of Search ..... 431/71, 18, 13, 431/14, 15, 25, 75, 78, 278, 281; 340/579

[56] References Cited

U.S. PATENT DOCUMENTS

| | | | |
|---|---|---|---|
| 3,561,900 | 2/1971 | Walbridge . | |
| 3,726,630 | 4/1973 | Potts | 431/74 |
| 3,914,092 | 10/1975 | Matthews . | |
| 3,986,813 | 10/1976 | Hewitt . | |
| 4,055,164 | 10/1977 | Wu-Heng . | |
| 4,082,493 | 4/1978 | Dahlgren . | |
| 4,111,639 | 9/1978 | Matthews . | |
| 4,194,875 | 3/1980 | Hewitt . | |
| 5,169,303 | 12/1992 | Paluck | 431/74 |
| 5,282,739 | 2/1994 | Chinsky et al. | 431/51 |
| 5,425,631 | 6/1995 | Krueger et al. | 431/6 |
| 5,429,111 | 7/1995 | Akamatsu | 126/39 BA |

FOREIGN PATENT DOCUMENTS

| | | | |
|---|---|---|---|
| 2155222 | 9/1985 | United Kingdom | F23N 5/26 |

*Primary Examiner*—Carl D. Price
*Attorney, Agent, or Firm*—Abelman, Frayne & Schwab

[57] ABSTRACT

In an electronic ignition system for igniting a plurality of gas burners by means of a plurality of electrodes, each one being mounted adjacent with each burner for producing sparks for the ignition of each burner. A spark generating circuit connected with the electrodes in order to produce the sparks for igniting each burner. And a power source connected to the spark generating circuit. A flame sensor circuit is connected to the spark generating circuit and at least one electrode, which in a first period and once the spark generating circuit has been activated for igniting each electrode, the flame sensor circuit is operated to detect the absence of flame on the burner by means of said electrode, and once that the burner has been ignited, the electrode and flame sensor circuit are operated for sensing the presence of flame on the burner. The flame sensor circuit is arranged to automatically reestablish flame when the electrode through of the flame sensor circuit senses that flame on the burner has been extinguished.

8 Claims, 3 Drawing Sheets

IN-HV
OUT-HV
10
12
14
16
18
20
22
24
26
28
30
32
34
36
38
40
42
44
46
50
52
54
56
58
60
62
64
66
68
70
72
74
98

ELECTRONIC IGNITION SYSTEM FOR A GAS STOVE

This application is a continuation-in part of application Ser. No. 08/948,597 filed on Oct. 10, 1997, now abandoned.

FIELD OF THE INVENTION

The present invention is referred to an electronic ignition system for gas stoves and more particularly, to an electronic ignition system for controlling the ignition operation of the various burners at the stove.

DESCRIPTION OF THE RELATED ART

A typical system to ignite the burners of a gas stove was to maintain a flame ignited all the time, through a pilot burner, positioned near of each burner. In this way, each time that a burner was open, this detected the existence of the flame, and so, the burner could be ignited. However, one of the main problems of the typical system was that, sometimes, the flame of the pilot burner was put out by the decrease of the gas pressure or by air flows, so that, when the user wanted to turn the burner on, it did not work. Furthermore, a dangerous concentration of gas in the kitchen would go unnoticed. If the user wanted to turn the burner on again (with matches or lighter), he would had have to ventilate the area to prevent from a possible ignition of the gas, that would have caused an explosion.

At the present, there are some areas where an electronic ignition system is already used for the ignition of gas burners. For example, the U.S. Pat. No. 3,914,092 assigned to Johnson Service Controls, it is referred to a direct spark ignition system for generating ignition sparks for igniting fuel discharged by a fuel outlet.

Another system for controlling a pilot and main burner gas valves of a gas furnace is shown in the U.S. Pat. No. 3,986,813 assigned to Cam-Stat Incorporated, including a pilot spark igniter and a pilot flame sensor. The system includes a relay having a first standby mode providing power to a spark ignitor circuit so that, when the thermostat switch is closed, a pilot valve solenoid is energized, and in a second operating mode disconnecting power from the power from the spark ignitor circuit and providing power to the main valve solenoid when the flame is sensed at the pilot burner. The system is provided with a fast responding circuit for operating the relay utilizing a 24 volts supply, with a 48 volt supply provided only for the flame sensor.

Other arrangements of gas burners that already use electronic ignition systems to operate are described and claimed in the U.S. Pat. Nos. 4,055,164; 4,082,493; 4,111,639; and 4,194,875, all of them related with control systems for the automatic ignition of the burners. However, in all the cases, these are referred for controlling the pilot and main burner gas valves (U.S. Pat. Nos. 4,082,493 and 4,194,875); for controlling the ignition of an auxiliary fire nozzle and a main fire nozzle in a water heater (U.S. Pat. No. 4,055,164); or to a self-checking fuel ignition system, which effects periodic testing of the operability of the spark generating circuit (U.S. Pat. No. 4,111,639).

Another arrangement of an ignition control device is described in the U.K. Patent Application GB 2 155 222 A published on Sep. 18, 1985, which describes an electronic control device for a gas burner which includes a logic circuit which diensables an oscillator of a spark generator when a flame is sensed at the burner and re-enables the oscillator if the flame is subsequently extinguished. If ignition has not ocurred within a safety time interval a further logic circuit, acting through a triac, causes a solenoid valve to close shutting off the gas supply. Circuit maintains the oscillator in an enabled condition even when the gas supply has been shut off thereby to provide a warning to the user.

In this case, the patent uses two neon to indicate that the flame has been detected. However, these neon are illuminated in a very short time, when the spark try to start the gas on the burner. This is, when the valve of an oven or grill is opened, a spark is generated before the supplying of the gas on the burner be feed. However, before the burner contains flames, a neon is intermittent illuminated until the flame is detected on the burner.

The U.K. patent also comments that when is not possible to start the oven and the gas valve is closed, the spark generator remains in a high state condition, so that the oscillator continues to be activated, and thus sparking continues after the gas valve has been closed, so as to indicate to the user of the oven that there are no flames present at electrode. This provokes that the life of the spark generator be reduced.

As can be seen of the previous art, the use of electronic circuits for the ignition of gas burners have different applications. In this case, the present invention is referred to a an electronic ignition system for gas stoves.

This electronic ignition system is shown in combination with a plurality of burners, which are located on the upper part of a stove and inside the oven of said stove. A plurality of electrodes are placed near and in coincidence with each burner, each electrode being activated to provide ignition sparks for the ignition of each burner. A spark generating circuit is connected with all the electrodes in order to generate the enough ignition sparks for igniting each burner. A plurality of switching means which are connected to spark generating circuit, the switching means being independently connected by each one of a series of valves on the stove. So, each time that a valve is open, the spark generating circuit is activated in order to provide ignition sparks by each electrode of each burner. And a power source connected to the spark generating circuit, the improvements characterized by: a flame sensor circuit connected between the spark generating circuit and at least one electrode, which in a first operating period and once the spark generating circuit has been activated for igniting one or more burners, it is operable to detect the absence of flame on the burners—by the electrodes—producing a sound by means of a buzzer, and in a second operating period—by the electrodes—, it is operated for detecting the presence of flame in the burner, and emitting a visual signal, once the burners have been ignited.

OBJECTIVES OF THE INVENTION

A first objective of the present invention is to provide an electronic ignition system for gas stoves, which includes an electronic circuit with an audiovisual alarm, which is operated for the ignition of each one of the burners of the stoves.

It is an additional objective of the present invention, to provide an electronic ignition system for gas stoves, wherein the detection of the flame on the burner is carried out by means of an ionization-rectification method, consisting of to apply a voltage between two electrodes in order to give a better flame presence.

An additional objective of the present invention is to provide an electronic ignition system for gas stoves that, in a first operating period, the electrodes are activated to provide ignition sparks for the ignition of each burner, and in a second operating period these are used as flame sensors.

Another objective of the present invention is to provide an electronic ignition system for gas stoves which detects the existence of flame on the burners by means of a light or for indicating the absence of flame by means of a buzzer.

Is another objective of the present invention to provide an electronic ignition system for gas stoves, for detecting the presence of flame, making use of all the outputs of the spark generating circuit, (which is generally composed by one primary coil and several secondary transformer coils) by allowing each coil of the secondary transformer of the said spark generating circuit to have one electrode per wire, thus two electrodes by coil. This is possible by the use of a gap of adequate length designed in the circuit, for the spark to jump, allowing a return path for the current.

These and other objects and advantages of the present invention shall be evident to the experts in the field, from the detailed description of this invention, that follows:

BRIEF DESCRIPTION OF THE DRAWINGS

The FIG. 1 is a schematic diagram illustrating the electronic ignition system for gas stoves of the present invention;

The FIG. 2 is a detailed diagram illustrating the electronic ignition system for gas stoves of the present invention; and, The FIG. 3 is an electrical diagram of the flame sensor circuit that is used with the present invention.

DETAILED DESCRIPTION OF THE INVENTION

Figure 1:
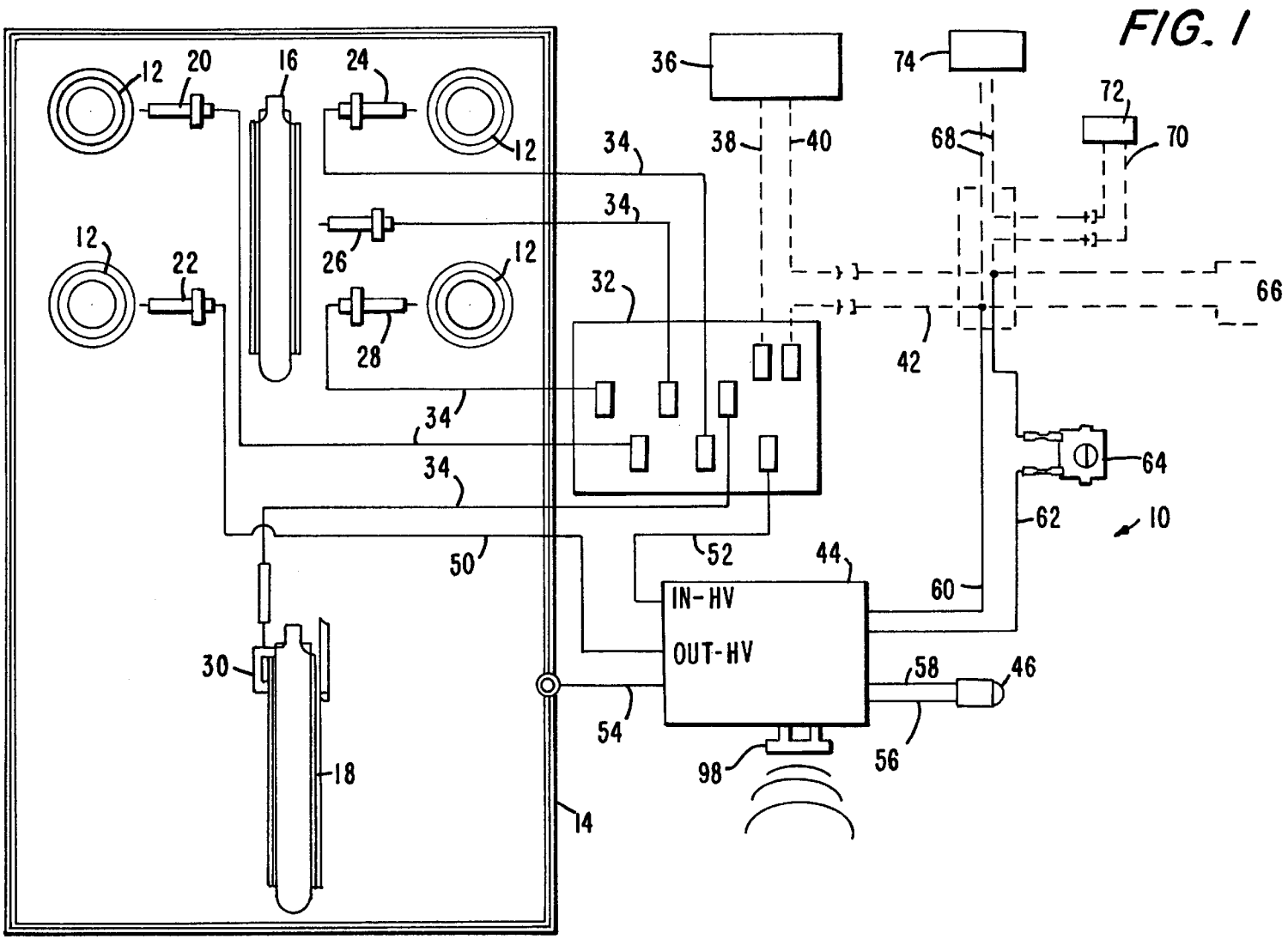

Having now more particularly reference to a preferred embodiment of the present invention, illustrated through the various figures, wherein like parts are designated by like reference characters, wherein the FIG. 1 is showing an electronic ignition system 10 for gas stoves, in accordance with the present invention. At the FIG. 1, the electronic ignition system 10 is showed in combination with four ring-shaped burners 12, which are placed in pairs on the upper part of the chassis 14 of a stove (not illustrated), and a first lengthened burner 16 located on the medium part of said chassis 14. Also in the FIG. 1 is showed, in a schematic form, a second lengthened burner 18, which corresponds to the oven of the stove (not illustrated).

Electrodes 20, 22, 24, 26, 28 and 30 are positioned adjacent to each burner 12, 16 and 18 to be ignited. The electrodes 20, 22, 24, 26, 28 and 30 includes a first operating period to ignite each burner 12, 16 and 18, and a second operating period to operate as flame sensors as will be described later. A spark generating circuit 32 is connected with each one of the electrodes 20, 22, 24, 26, 28 and 30, by means of supply lines 34 in order to generate sparks for igniting each burner 12, 16 and 18. A plurality of spark switches 36 that are connected to the spark generating circuit 32, said switches 36 being connected to each one of the valves in the stove (not illustrated). So, each time that a valve is open, a switch 36 is energized in order to activate the spark generating circuit 32 for producing ignition sparks by each electrode 20, 22, 24, 26, 28 and 30 of each burner 12, 16 and 18. The switches 36 are coupled under pressure in each one of the valves (not illustrated) of the burners 12, 16 and 18. A supply line 38 connects the spark generating circuit 32 with each one of the spark switches 36. Lines 40, 42 connects a power source of 127 volts ac to the spark generating circuit 32 and spark switches 36.

A flame sensor circuit 44 connected to the spark generating circuit 32, to signalize the presence of flame in each of the burners 12, 16 and 18 by means of the functioning of said flame sensor circuit 44. The presence of flame in each burner 12, 16 and 18 is provided by means an indicating light 46. The absence of flame in each burner 12, 16 and 18 is provided by the sound of a buzzer 98. The flame sensor circuit 44 comprising seven output terminals (not illustrated): a first terminal is connected by means of the line 50 to the electrode 22 of the burner 12. Through line 52, the flame sensor circuit 44 is connected with the spark generating circuit 32. The line 54 is connected to the chassis 14 of a stove (not illustrated) to provide a ground connection. Two lines 56, 58 are used to provide voltage to the indicating light 46 to register the presence of flame; and, finally, the lines 60, 62 are used to provide a feed voltage of 127 volts to the flame sensor circuit 44. The line 62 including a switch 64 for interrupting the current at the flame sensor circuit 44. The switch 64 being coupled on the valve of the oven (not illustrated). The lines 40 and 62, as well as, the lines 42 and 60 comprising a plug 66 which is connected to a power source to provide energy to the ignitor electronic system. The power feeding lines 40, 42, furthermore comprising two power lines 68, 70, which are connected to an incandescent lamp 72 to illuminate the internal part of the oven. A current switch 74 is connected with the line 68 to turn on or turn off the incandescent lamp 72 of the oven (not illustrated).

Figure 2:
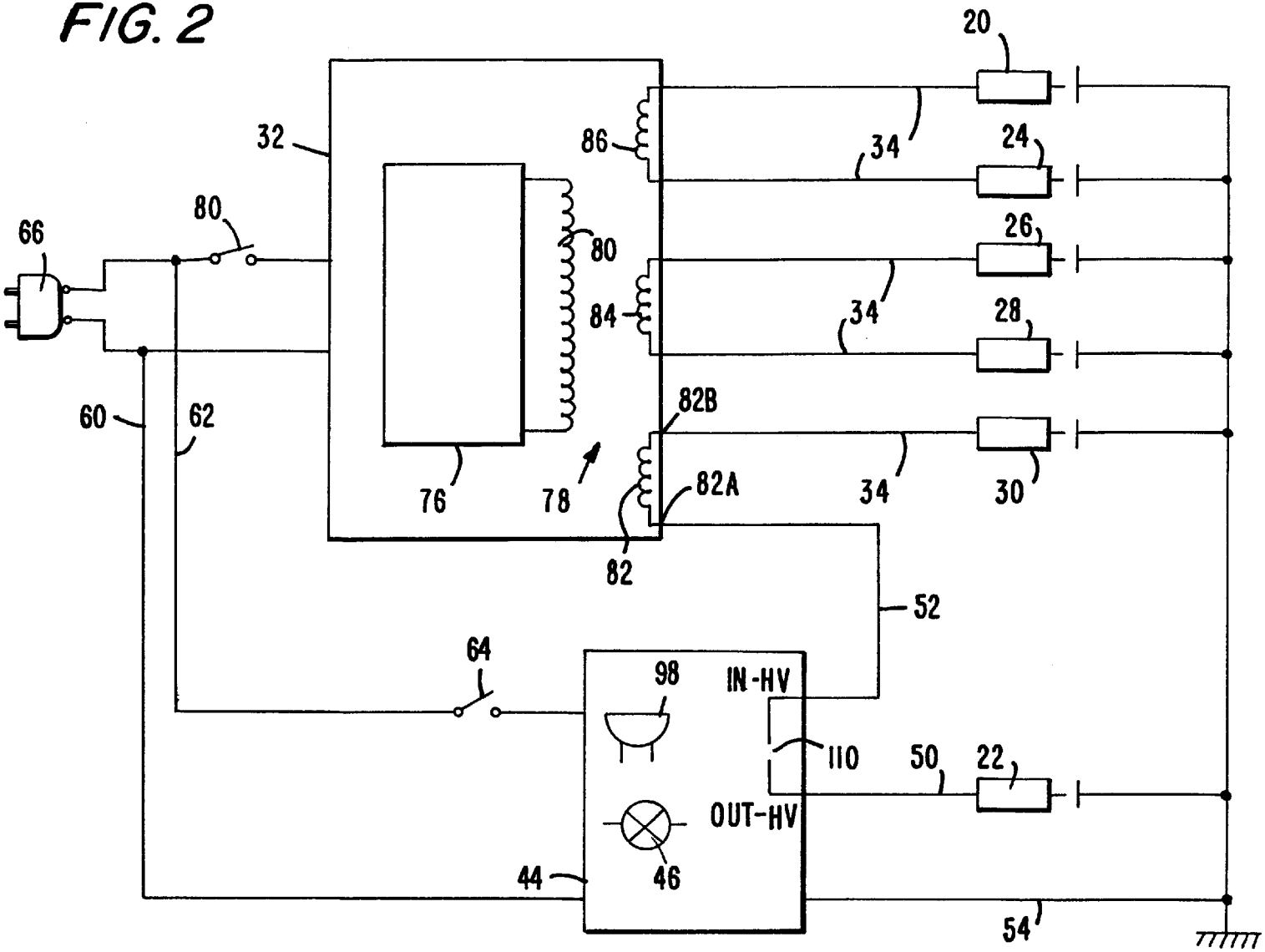

Reference to FIG. 2, a schematic diagram illustrating of the spark generating circuit 32 is illustrated, which includes an electronic circuit 76 that is connected to voltage regulating transformer 78, said transformer 78 comprising a coil or primary winding 80 and three coils or secondary windings 82, 84, 86. Each secondary winding being connected independently for each two electrodes by means of the lines 34 and 50. The electronic circuit 76 generates a voltage for charging and discharging a capacitor (not illustrated) by means of said transformer 78. In the FIG. 2 also is showed a general switch 80 which is connected to the line 62 for turning off or turning on the electronic ignition system 10.

The flame sensing circuit 44 is connected to a terminal 82A of the secondary winding 82 by the line 52, while the other terminal 82B of said secondary winding 82 is connected to the electrode 30 to ignite the gas of the burner 18. In addition the flame sensor circuit 44 is connected to the electrode 22 by means of the line 50, to allow the generation of two sparks out of the same secondary winding 82. To allow the detection of flame in any burner, a gap 110 is introduced, which permits the identification of the any burner where flame is being detected.

Figure 3:
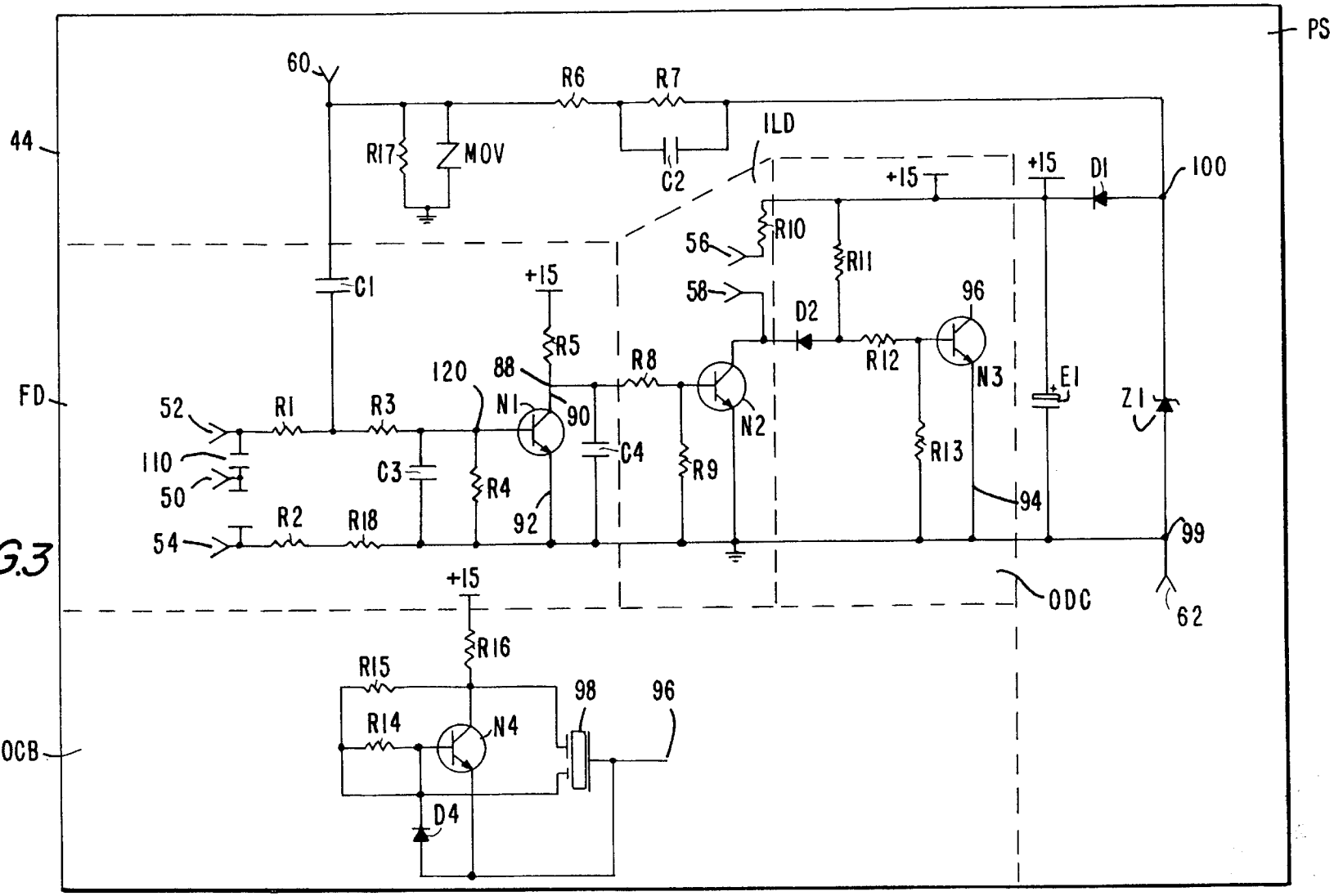

Making now reference to the FIG. 3, an electrical diagram for the flame sensor circuit 44 is illustrated, which comprises three lines 50, 52 and 54, For the detection of the flame, an ionization-rectification method is used. This method consists of to apply a voltage between two electrodes (for example an electrode and a burner), through which the current is circulated more easily by the ionization of the ambient. The flame is detected by the line 52, which corresponds to the words IN-HV (FIGS. 1 and 2) and the line 54 connected to the chassis 14 (FIGS. 1 and 2). The line 52 is connected to a resistor R1 to increase the input impedance. The resistor R1 is connected in series with resistor R3 to provoke a polarization to the basis of a transistor N1. An output line 90 of the transistor N1 is connected with the resistor R5 through the point 88, in order to feed a voltage to the circuit from about 15 volts. The other output line of transistor N1 (line 92) is connected in parallel with the line 54. The resistor R8 is connected at the point 88, which also is connected with the transistor N2 to polarize the diode D2. The line 58 is connected between the transistor N2 and diode D2, which corresponds to one of the lines (cathode) of the indicating light 46. The diode D2 is connected in series with a resistor R12 and a transistor N3. From the transistor N3, two lines 94 and 96 are connected. The line 94 is connected in parallel with the line 54, meanwhile, the line 96 is connected to the buzzer 98 of the oscillator circuit of the buzzer OCB. The oscillatory circuit OCB furthermore comprising resistors R14, R15, R16, the transistor N4 and the diode D4.

The line 54 is connected to the chassis 14 of the stove (not illustrated). Two resistors R2 and R18 are connected to the line 54, which are connected with the neutral line 62, thereby current to the circuit 44, at point 99 is provided. A capacitor C3 to generate a signal of sine voltage is connected in parallel form between lines 52 and 54. A resistor R4 also is connected in parallel form between lines 52 and 54 to help to resistor R3 in the polarization of the transistor N1. Also, a capacitor C4 and resistor R9 are connected in parallel between said lines 52 and 54. By this arrangement, the capacitor C4 is energized by the resistor R5, energizing the transistor N2 by the resistors R8 and R9. Finally, the resistor R13 together with the resistors R11 and R12 are associated to avoid the polarization of the transistor N3, at the moment that the transistor N2 is overcharged. The resistor R11 is connected in parallel with the line 62, said line 62 providing energy to the circuit.

As can be seen in the spark generating circuit in FIG. 3, one of the lines that are used to supply the energy (neutral line 62), is connected in series to a diode Z1, to maintain the voltage about 15 volts. At the point 100 of the circuit, the line 62 is connected to diode D1 to rectify and to generate a continuous voltage. The diode D1 is connected in series with a resistor R10 to limit the current of the line 56, and so, energizing the indicating light 46. A capacitor E1 is connected in parallel between the line 54 and line 56 for filtering a frequency of about 60 Hz in the supply line 62. Also are connected two resistors R6 and R7 for limiting the current of the transitory, a capacitor C2 for limiting the input voltage; a protection device MOV; and a resistor R17 for protecting the circuit. Finally, the line 60 is connected in series with the line 62 in order to generate a sine signal to circuit 44.

Operation of the System

When the upper burners 12 and 16 of a stove (not illustrated) are required to be ignited, it is necessary that a valve control by each burner (not illustrated) be turned on. At the moment that a valve is turning on, a switch 36 that corresponds to the selected burner is also energized. Once that the switch 36 is energized, the spark generating circuit 32 is energized to generate a spark frequency from 6 to 10 by second, to the corresponding electrode of the selected burner (burners 12 or 16). Once the burner is ignited, the switch 36 is deenergized in order to stop the ignitor sparks in the electrode.

Referring to the burner 18, which corresponds to the oven of stove (not illustrated), this is ignited as follows: A valve (not illustrated) of the oven should be pressed and turned on, and in this moment, the buzzer 48 will start a sound. Following, one of the spark switch 36 is pressed on (which corresponds to the electrode 30), and once the burner 18 of the oven is ignited, the indicating light 46 will turned on and the buzzer 48 will be turned off. It is important to comment that the oven switch is very similar to the electronic starting switches of the burners 12 and 16. The difference is that, the switch of the oven closes in all its rotary turning and the switches of the upper burners only in a position. Notwithstanding the electrodes are used to ignite the burners 12, 16 and 18, said electrodes also have the function for detecting the flame, due that these have been connected with the flame sensor circuit 44.

Operation Circuit

As was previously commented, the electrodes 20, 22, 24, 26, 28 and 30, includes a first operating period to ignite each burner 12, 16 and 18, and a second operating period to operate as flame sensors.

In order to understand the operation of the electronic circuit 44, this has been separated in four sections, a first section for detecting the flame FD; a second section for indicating a light driver ILD; a third section for an oscillator driver circuit ODC; and a fourth section for an oscillatory circuit for the buzzer OCB. A power source PS is indicated by separated.

In this way, the section for detecting the flame FD uses a ionization-rectification method. This consists in apply a voltage between electrodes (for example, a burner and an electrode), through which the voltage circulates more easily due to an ionized environment. The flame is detected by the line 52 and the line 54. The line 50 is connected to the electrode 22 (FIGS. 1 and 2) in order to establish one of the two sparks that will be generated by the secondary winding 82 (FIG. 2). So, by means of the gap 110, the flame in an specific burner will be identified. Two resistors R2 and R18 are connected to the line 54, which are connected with the neutral line 62, thereby current to the circuit 44, at point 99 is provided.

Then in a first operation period, the spark generating circuit 32 (FIGS. 1 and 2) is activated by means of the switch 80 (FIG. 2) so, in this way, the sparks are generated by means of the spark sensor circuit 44 through the line 52, the gap 110 and the line 50, which are disconnected by the resistor R1 of the flame detecting circuit FD.

In this first operation period the flame is not present on the burner, however the resistors R1, R3 y R4, as well as, the capacitors C1 and C3 of the flame detecting circuit FD are used to generate a sine wave with offset zero on the point 120, in order to polarize the transistor N1 by pulses, which are used to charge and discharge the capacitor C4 through the resistor R5 on the point 88, all this in the flame detecting circuit FD.

The charge and discharge of the capacitor C4 of the flame detecting circuit FD does not permit to polarize in a direct way the transistor N2 by means of the resistor R8 and R9—which are showed in the indicating light driver circuit ILD—, so that, the line 58 through which is connected the indicating light 46 (FIGS. 1 and 2) is not carried out to a level of zero. In this way, the flame is not being detected and the indicating light 46 is not lightened. The diode D1 of the power source PS, is connected in series with a resistor R10 to limit the current of the line 56, and so, energizing the indicating light 46.

At the same time, the diode D2 of the oscillator circuit driver ODC is found in a inverse polarization, permitting that the transistor N3 be directly polarized by the resistors R11, R12 and R13. So, when the transistor N3 is polarized, the line 96—that connects the oscillatory driver circuit ODC with the oscillator circuit of buzzer OCB—is carried out to zero, to provide energy to the circuit OCB, in order to the buzzer 98 can emit a sound indicating that flame on the burner 18 was not detected.

In a second operation period, once the flame on the burner 18 is detected, the switch 80 is deactivated (FIG. 2) and no more sparks are generated on the electrode 30. In this way, the electrode 30 that was used to provide sparks on the burner 18 is now used to sense the flame of the burner 18, which present a voltage on said electrode 30. Said voltage is provided by the resistor R1 and the capacitor C1 of the flame detecting circuit FD.

In this way, the voltage is rectified, provoking that the sine wave generated by the resistors R1, R3 and R4, and the capacitors C1 and C3, of the flame detecting circuit FD have a negative offset, provoking that the sine wave be displaced below of the 0 volts on the point 120 so, the transistor N1 is not polarized and a cutting state is maintained. This effect permits that the capacitor C4 be charged by the resistor R5.

When the capacitor C4 of the flame detecting circuit FD is charged, the transistor N2 is polarized in direct way by the resistor R8 and R9. This permits that the line 58 through which the indicating light 46 is connected (FIGS. 1 and 2) is carried out to zero volts by the transistor N2, allowing that the indicating light 46 be illuminated, showing that flame on the burner has been detected.

At the same time, the diode D2, of the oscillatory driver circuit ODC is also carried out to zero volts by the transistor N2, and so, the diode D2 is polarized in a direct way, but not permitting the polarization of the transistor N3. So, the line 96 is not carried to zero volts and the energy toward the buzzer 48 is interrupted. The buzzer 48 is turned off when the detection of the flame on the burner 18 is detected.

In this way, the flame detecting circuit FD will be maintained in this second operation period during the time that the presence of flame be detected on the burner.

In order to allow the generation of two high voltage sparks per every secondary winding 82, 84, 86, and allowing the flame presence to be detected in any of each pair of two electrodes [20, 24], [26,28], [30,22] associated with each secondary winding 82, 84, 86, a gap 110 was included, which allows the correct identification of the burner where flame detection is being detected. By including said gap 110 between the lines 52 and 50 of the electronic circuit 44, flame ionization signals from each burner electrode 30 and 22 are effectively separated, although they are associated to the same secondary winding 82. Without said gap 110, any secondary winding 82, 84 or 86 could detect only one electrode flame.

As can be seen of the embodiment described above, an electronic ignition system 10 for gas stoves has been described and illustrated, which facilitate the ignition of the burners of a gas stove. However, it shall have to be understood that said invention must not be limited to the embodiment above illustrated. Thus, being evident to the specialists of the field that other arrangements, as well as additional functions thereof, could be implemented, which should be clearly contained within the scope and intendment of this invention, as claimed in the following claims.

We claim:

1. An electronic ignition system (10) for igniting a plurality of gas burners (12, 16, 18) which comprises:

a spark generating circuit (32) to produce sparks for igniting each of said plurality of gas burners;

a plurality of electrodes (20, 22, 24, 26, 28, 30), each one of said plurality of electrodes being connected with said spark generating circuit by a separate connection (34), said separate connection conducting a portion of said sparks to one of said plurality of electrodes, each one of said plurality of electrodes being mounted adjacent to a different one of said plurality of gas burners than the remainder of said plurality of electrodes, said one of said plurality of electrodes emitting said portion of said sparks for the ignition of the one of said plurality of gas burners to which said one of said plurality of electrodes is mounted adjacent;

and a flame sensor circuit (44) connected between the spark generating circuit and at least one of the plurality of electrodes, which in a first period and once the spark generating circuit has been activated for producing said sparks, said flame sensor circuit is operated to detect the absence of flame on any of at least one of said plurality of gas burners, each of said at least one of the plurality of electrodes being mounted adjacent to one of said at least one of said plurality of gas burners, by means of said least one of the plurality of electrodes, and in a second period and once each of said plurality of gas burners has been ignited, said at least one of the plurality of electrodes and said flame sensor circuit are operated for sensing the presence of flame on said at least one of said plurality of gas burners, said flame sensor circuit possessing a power source through which energy is provided to said flame sensor circuit, a positive line (60) and a neutral line (62) being connected to the power source to provide energy to said circuit, wherein the flame sensor circuit comprises a circuit for applying a voltage between at least another of the plurality of electrodes and the burner to which said another of the plurality of electrodes is mounted adjacent, said circuit for applying a voltage being connected with the spark generating circuit to send a representative current signal for detecting the absence or presence of flame on said at least one of said plurality of gas burners; said circuit for applying the voltage comprising:

a first resistor (R1), said first resistor being connected by one end to a first sensing line (52) in order to increase an input impedance to the flame sensor circuit, said first sensing line being connected to the spark generating circuit;

a second sensing line (50), said second sensing line being connected with said at least one of the plurality of electrodes, said first sensing line and said second sensing line being used to effectuate the flame detection between an electrode and a burner;

a second resistor (R3) connected in series with the first resistor (R1);

an uncoupling device connected between a third line (54) connected to a frame of a stove and a neutral line (62) of the flame sensor circuit, in order that the neutral line not be directly connected to the frame of the stove;

a transistor (N1), a base of said transistor (N1) being connected with the second resistor (R3) in order to provoke a polarization to said transistor, said transistor being connected with the neutral line that is feeding energy to the flame sensor circuit;

a third resistor (R5) directly connected with a collector of said transistor (N1) for feeding the voltage of said flame sensor circuit;

a first capacitor (C3) connected with the transistor (N1) and with the neutral line (62);

a fourth resistor (R4) connected in parallel with the first capacitor (C3), to aid the second resistor (R3) in the polarization of the transistor (N1); and, a second capacitor (C1) connected with the first resistor (R1);

said first resistor (R1), said third resistor (R5), and said uncoupling device, having parameters selected in order to rectify a voltage signal and to generate a continuous voltage which is subtracted from a sine signal generated by said second capacitor (C1), by said first capacitor (C3), by said second resistor (R3) and by the fourth resistor (R4), provoking in this way an inverse polarization of the transistor (N1), so that, the flame sensor circuit can be put in a cut position when the presence of flame is detected each of said at least one of said plurality of gas burners or in a saturation position when absence of flame is detected on any of said at least one of said plurality of gas burners.

2. The electronic ignition system for igniting a plurality of gas burners as claimed in claim 1, wherein the flame sensor circuit and the spark generating circuit are connected by means of the first resistor (R1), said first resistor being used to prevent the sparks generated by the spark generating circuit from causing a malfunction of the flame sensor circuit and, at the same time, to allow the generation of two sparks by each secondary winding of the spark generating circuit in order to detect and to identify the presence of flame in each of said at least one of said plurality of gas burners by a gap between the first sensing line (52) and the second sensing line (50).

3. The electronic ignition system for igniting a plurality of gas burners as claimed in claim 1, wherein the detection of flame between each of said at least one of said plurality of electrodes and each of said at least one of said plurality of gas burners is carried out by means of an ionization-rectification effect.

4. The electronic ignition system for igniting a plurality of gas burners as claimed in claim 1, wherein the uncoupling device comprises:

a fifth resistor (R2) connected to the third line (54) of the frame of the stove; and, a sixth resistor (R18) connected to the first resistor (R2), which is connected with the neutral line (62) of the flame sensor circuit, said fifth resistor (R2) and said sixth resistor (R18) being connected in a series connection and being utilized to uncouple the third line (54) and the neutral line (62) by means of a high impedance.

5. An electronic ignition system (10) for igniting a plurality of gas burners (12, 16, 18) which comprises:

a spark generating circuit (32) to produce sparks for igniting each of said plurality of gas burners;

a plurality of electrodes (20, 22, 24, 26, 28, 30), each one of said plurality of electrodes being connected with said spark generating circuit by a separate connection (34), said separate connection conducting a portion of said sparks to one of said plurality of electrodes, each one of said plurality of electrodes being mounted adjacent to a different one of said plurality of gas burners than the remainder of said plurality of electrodes, said one of said plurality of electrodes emitting said portion of said sparks for the ignition of the one of said plurality of gas burners to which said one of said plurality of electrodes is mounted adjacent; and a flame sensor circuit (44) connected between the spark generating circuit and at least one of the plurality of electrodes, which in a first period and once the spark generating circuit has been activated for producing said sparks, said flame sensor circuit is operated to detect the absence of flame on any of at least one of said plurality of gas burners, each of said at least one of the plurality of electrodes being mounted adjacent to one of said at least one of said plurality of gas burners by means of said at least one of the plurality of electrodes, and in a second period and once each of said plurality of gas burners has been ignited, said at least one of the plurality of electrodes and said flame sensor circuit are operated for sensing the presence of flame on each of said at least one of said plurality of gas burners, said flame sensor circuit possessing a power source through which energy is provided to said flame sensor circuit, said power source receiving energy by means of a positive line (60) and a neutral line (62) to provide energy to said circuit, wherein the flame sensor circuit comprises:

a circuit for applying a voltage between at least another of the plurality of electrodes and the burner to which said another of the plurality of electrodes is mounted adjacent, said circuit for applying a voltage being connected with the spark generating circuit to send a representative current signal for detecting the absence or presence of flame on said at least one of said plurality of gas burners;

an indicating light driver circuit connected to the circuit for applying a voltage, which receives the presence of flame on each of said at least one of said plurality of gas burners, allowing the current to be sent to an indicating light for indicating the presence of flame on each of said at least one of said plurality of gas burners;

an oscillator circuit driver connected to the indicating light driver circuit in order to prevent the current from flowing toward said oscillator circuit driver, said oscillator circuit driver generating an inverse polarization when the presence of flame on each of said at least one of said plurality of gas burners is detected; and, an oscillator circuit of a buzzer connected to the oscillator circuit driver to receive a current when a direct polarization has been received in said oscillator circuit of a buzzer and, in this way, an audible signal in the buzzer is generated.

6. The electronic ignition system for igniting a plurality of gas burners as claimed in claim 5, wherein the indicating light driver circuit comprises:

a capacitor (C4);

a first resistor (R8) connected with said capacitor (C4);

a second resistor (R9) connected with the first resistor (R8);

a transistor (N2) connected with the capacitor (C4), the first resistor (R8) and the second resistor (R9);

a third resistor (R10) connected with the transistor (N2) for supplying voltage to said transistor (N2);

said first resistor (R8), said second resistor (R9) and said capacitor (C4) being used to directly polarize the transistor (N2), allowing current to be sent to an indicating light to indicate the presence of flame on each of said at least one of said plurality of gas burners.

7. The electronic ignition system for igniting a plurality of gas burners as claimed in claim 5, wherein the oscillator circuit driver comprises:

a diode (D2) connected to the indicating light driver circuit;

a first resistor (R12) connected with said diode (D2);

a transistor (N3) connected with the first resistor (R12), a first exit line of the transistor (N3) being connected with the neutral line (62) and a second exit line of the transistor (N3) being connected to said oscillator circuit of a buzzer;

a second resistor (R11) connected between said first resistor (R12) and said diode (D2), said second resistor (R11) being connected with a feeding line to provide voltage;

a third resistor (R13) connected with the transistor (N3) and the neutral line (62);

said first resistor (R12), said second resistor (R11), said third resistor (R13) and said diode (D2) being used to avoid the polarization of the transistor (N3) when presence of the flame is detected on each of said at least one of said plurality of gas burners.

8. The electronic ignition system for igniting a plurality of gas burners as claimed in claim 5, wherein said at least one of the plurality of electrodes are arranged to operate in a first operation period to ignite each of said at least one of plurality of gas burners and in a second operation period to operate as flame sensors.

* * * * *